US005901501A

United States Patent [19]

Fountaine

[11] Patent Number: 5,901,501

[45] Date of Patent: May 11, 1999

[54] WINDOW FASTENER

[75] Inventor: Howard John Fountaine, Auckland, New Zealand

[73] Assignee: Interlock Group Limited, Wellington, New Zealand

[21] Appl. No.: 08/920,908

[22] Filed: Aug. 29, 1997

[30] Foreign Application Priority Data

Aug. 29, 1996 [NZ] New Zealand ..... 299260

[51] Int. Cl.[6] ..... E05F 1/00

[52] U.S. Cl. ..... 49/449; 292/228

[58] Field of Search ..... 49/394, 395, 449, 49/450; 292/228, 198, 203, DIG. 20

[56] References Cited

U.S. PATENT DOCUMENTS

| | | | |
|---|---|---|---|
| 939,480 | 11/1909 | Deggim | 292/228 |
| 1,058,584 | 4/1913 | Hendricks | 292/228 X |
| 1,728,276 | 9/1929 | Hoyt | 292/228 X |
| 2,503,370 | 4/1950 | Zanona | 292/228 X |
| 2,802,682 | 8/1957 | Enckevort | 292/228 X |
| 2,950,137 | 8/1960 | Check | 292/228 |

OTHER PUBLICATIONS

Sidney Preston Williams, "An Improved Casement or Door Catch", eleven pages, New Zealand specification 118613, Apr. 16, 1957.

Arthur Joseph Quinn, "Child–Proof Lock", twenty pages, New Zealand specification 211470, Apr. 15, 1985.

*Primary Examiner*—Jerry Redman
*Attorney, Agent, or Firm*—Young & Thompson

[57] ABSTRACT

A fastener for use with a sliding sash window. The fastener has a body (11) with a handle (14) mounted with the body for pivotal movement about a pivot axle (17). A latch tongue (18) is operatively coupled to the handle (14). A latch plate (21) has a latching surface (23) which is engageable in face to face contact with the end of the latch tongue (18). The latching surface (23) is spaced from the pivot axle (17) in the direction in which a sash (S) of a window is movable from a closed position relative to the frame (F) of the window. The handle (14) is movable about the pivot axle (17) to move the end of the latch tongue (18) away from its latching contact with the latching surface (23) of latch plate (21) to permit the window sash (S) to move from the closed position.

19 Claims, 6 Drawing Sheets

WINDOW FASTENER

BACKGROUND OF THE INVENTION

1. Discussion of the Background

The present invention relates to a window fastener and more particularly relates to a window fastener which has application with a sliding sash window.

2. Description of the Related Art

A window fastener is used to fasten or latch a window in the closed position. Thus a person wishing to open the window must firstly release the fastener after which the window can be slid to an open position. When the window is moved to the closed position the user relatches the fastener so as to prevent the window from being opened from the exterior. This need to relatch the fastener when the window is moved to the closed position can present a security problem especially if the window can be moved to the closed position and appear to be latched even though the fastener is not latched into the locking position.

A further problem which can arise with a window fastener for a sliding window is that the application of a force to the outside of the window by, say, someone wishing to gain unauthorised entry could be used to force the window fastener to unlatch and thereby permit unauthorised entry to take place.

SUMMARY OF THE INVENTION

An object of the present invention is to provide a window fastener which is particularly suitable for use with a sliding window and which automatically latches into the locked position when the window is moved to the closed position.

A further object of the present invention is to provide a window fastener which is particularly suited for sliding windows whereby the latching or locking effect of the window fastener tends to increase upon any external force being applied to the window in order to open the window.

Broadly, in one aspect of the invention there is provided a fastener for a sliding sash window, the fastener including a body, a handle pivotally mounted with said body to be movable between first and second positions, a latching means operatively coupled to said handle, biasing means to bias the handle to said first position, a latch plate having a latching surface with which said latching means is engageable, the latching means being movable from engagement with the latching surface in response to the handle being moved to said second position, movement inducing means to cause the handle to move to said second position in response to relative movement between the body and latch plate in a closing direction corresponding to that in which a window to which the fastener is attached moves to a closed position, the latching surface being located forward of the axis of pivotal movement of the handle in a direction opposite to said closing direction.

In a preferred form of the invention two latching portions are provided each engaging with a separate latching surface.

According to a second broad aspect of the invention there is provided a fastener for a window having a sash movable in a sliding direction between open and closed positions, the fastener including a body, a handle pivotally mounted with the body, at least one latching tongue coupled to the handle via a release device, a latching plate having a latching surface with which an engagement surface of the latching tongue is engageable when the fastener is in a latching position, the latch plate having a mounting surface, the latching surface being located at an angle to the mounting surface whereby the handle is pivotally movable to move said latching tongue from said latching position to a non-latching position where the latching tongue is clear of the latching plate, there being biasing means to bias the latching tongue to said latching position.

DESCRIPTION OF THE PREFERRED EMBODIMENTS

Figure 1:
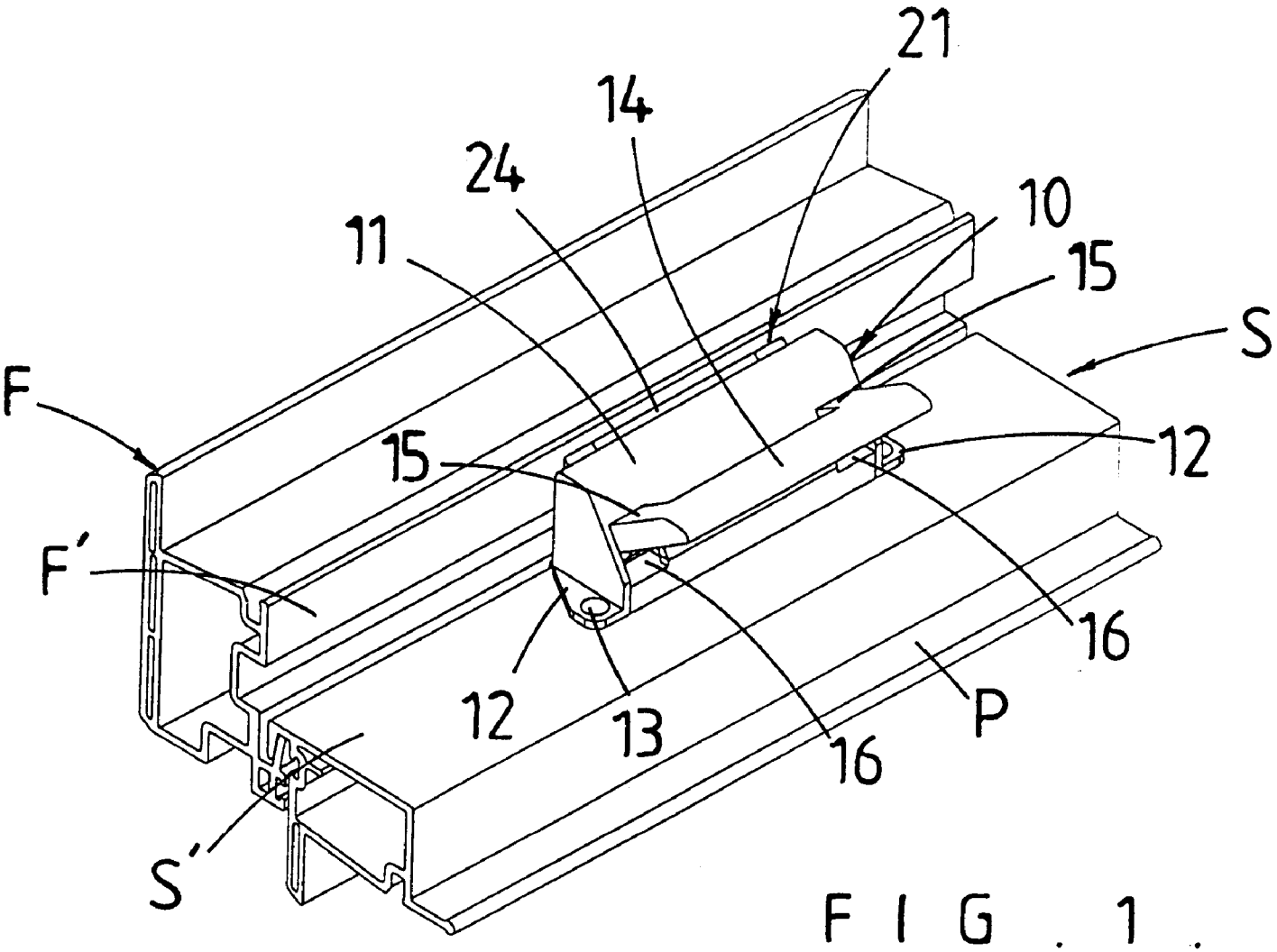
FIG. 1 is a perspective view of a part of a sash and frame of a sliding window with a window fastener according to the present invention located thereon, the sash being shown in the closed position relative to the frame.

In the drawings there is shown a part of the frame F of a sliding window and a part of the sash S of the window. The window is one where the sash S is mounted for sliding vertical movement from a closed to an open position. The sash S thus includes a flange or projection P which a user can grasp, possibly in conjunction with part of the sash S, to move the sash up and down between open and closed positions.

Figure 3:
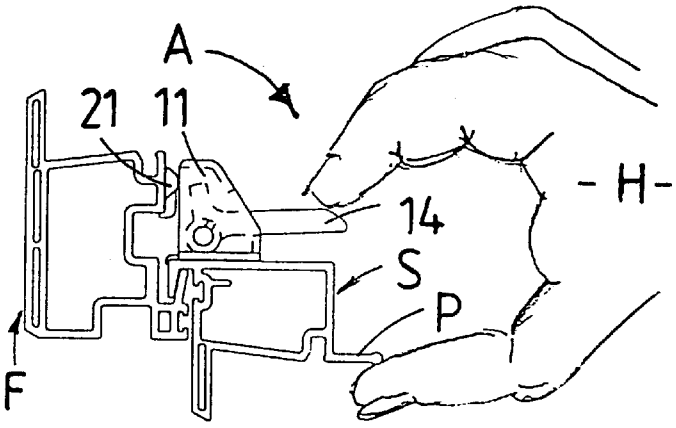
FIG. 3 is a view similar to FIG. 2 but showing the window fastener being released to enable the sash to be moved to an open position.

This is, for example, illustrated in FIG. 3 where the hand H of the user with his or her thumb T engage with the flange/projection P. While the drawing shows the hand interacting with the window fastener 10 this is for the purposes of showing the unlatching of the window fastener. Therefore, in normal operation of the window to, say, adjust the open position or move the sash to the closed position the fingers of the user's hand would engage with the flat surface S' of the sash S or indeed with the flange/projection P to move the sash S.

The window fastener 10 according to the present invention comprises a body 11 having a pair of mounting flanges 12 through which mechanical fasteners 13 can be engaged to mount the body 11 to the surface S' of the sash S. In a preferred arrangement the body 11 could be enclosed within a removable casing (not shown) so as to hide the flanges 12 and fastening 13 as well as to provide a more streamlined and aesthetically pleasing appearance to the fastener.

A substantially U-shaped handle 14 is provided with the leg portions 15 thereof extending through openings 16 in the body 11. The leg portions 15 are mounted within the body 11 by a common shaft, pair of stub shafts, or other pivot mountings 17 so that the handle 14 can be pivoted from a first position as shown in, say, FIG. 2 to a release position as shown in FIG. 3.

Extending to the other side of the pivot mount and at an angle to the leg 15 is a latching projection 18. This latching portion 18 projects through a suitable opening in the body 11 so as to project beyond the rear face 20 of the housing 11.

Figure 2:
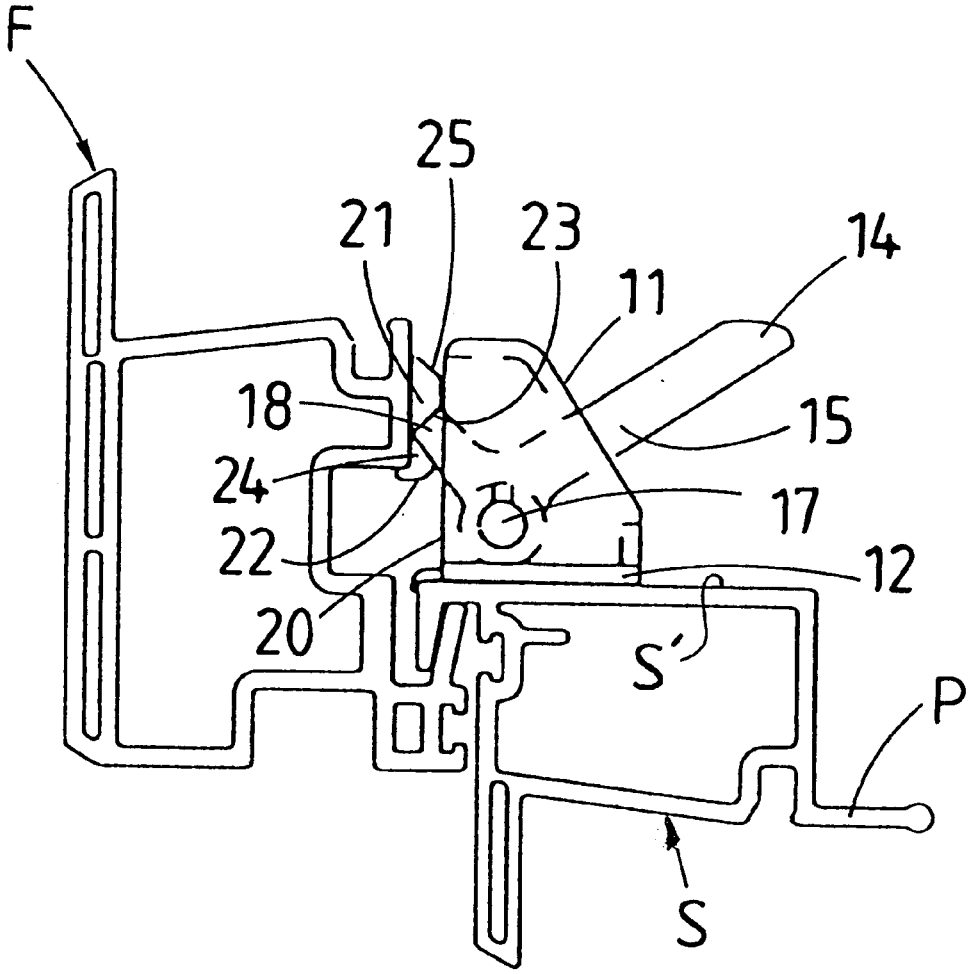
FIG. 2 is an elevation view of the arrangement shown in FIG. 1.

Suitable biasing means such as a coil spring or the like (not shown) is provided to bias the handle 14 to the position shown in FIGS. 1 and 2. The extent by which the handle 14 can be moved by the biasing means is limited by a suitable stop which, in the illustrated form, is the upper extremity of the opening 16 which engage with the legs 15. Similarly, the lower extremity of the opening 16 can provide a stop for limiting the extent of movement of the handle 14 against the biasing effect.

Mounted with the vertical face F' of the frame F is a latching plate 21. This latching plate has a mounting surface which can be mounted to the surface F' by suitable means such as mechanical fasteners, adhesive or the like. Preferably the latching plate 21 includes a lip 22 which extends over the lower end of the surface F' to provide an additional mechanical resistance to movement in an upward direction of the latch plate 21 on the surface F'.

The latch plate 21 includes a shoulder 23 which, as shown in FIG. 2, interengages with the latching projection 18 of the handle 14. The surface of the shoulder 23 is inclined relative to the surface F' and abuts face to face with the end or engagement surface of the latching projection 18.

A pair of latch plates 21 can be provided, one for each latching portion 18 of the handle 14. In the preferred form of the invention a single latching plate 21 is provided (as shown) with two separate shoulders 23, one being for each latching portion. As a consequence, a land 24 is formed between each of the latching shoulders 23 so as to provide an abutment to prevent any lateral movement of the sash S in the region of fastener 10 from taking place by, say, someone applying an external sideways movement to the window in order to try and release the latching projections 18 from the latching shoulders 23.

In use of the window fastener and with the window in the closed and latched position as shown in FIG. 1, a user simply grasps, as shown in FIG. 2, the flange/projection P of the sash S and the handle 14 so as to move the handle 14 in the direction of the arrow A toward the surface S' of the sash S. This releases the latching projections 18 from the latching shoulders 23 thereby allowing the sash S to be moved in an upward direction (arrow B) as shown in FIG. 3.

Figure 5:
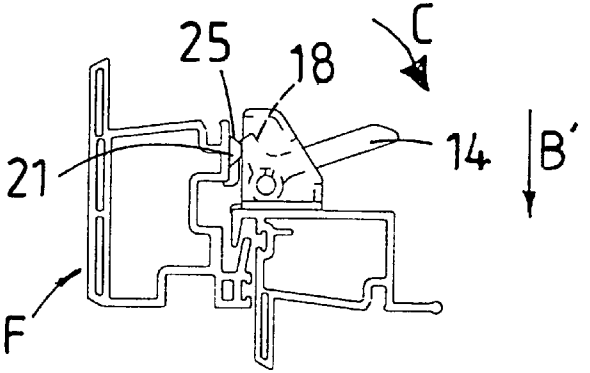
FIG. 5 is yet a further elevation view showing the sash having been moved from the position shown in FIG. 4 to a point where it approaches the fully closed position.
Figure 4:
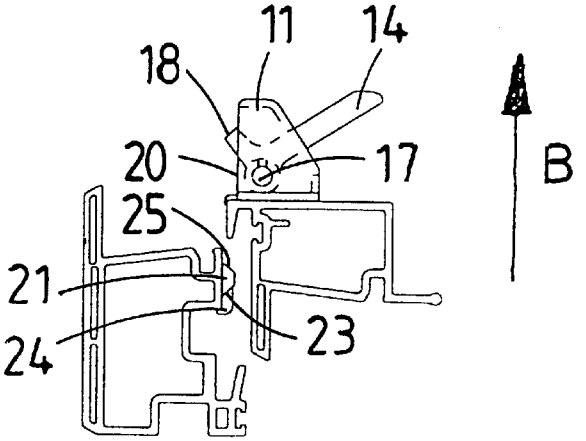
FIG. 4 is yet a further similar view showing the sash moved to an open position.

Upon the window being moved in the opposite or downward direction (arrow B') as shown in FIG. 5 the underside of each latching projection 18 engages with a ramp surface 25 of the latch plate 24. As shown in FIG. 5 this causes the handle 14 to move in the direction of arrow C as the sash S approaches its fully closed position. When in the fully closed position the biasing effect causes the handle 14 to counter rotate about axle/shaft 17 so that the latching projections 18 engage with the latching shoulders 23 as shown in FIG. 2.

As a consequence, the window fastener automatically relatches and locks the window upon the sash S being moved to the closed position. The user, therefore, does not need to specifically relatch the fastener to lock the window.

The interface of the latching shoulders 23 with the latching projection 18 is at an angle to the direction of opening of the window sash. Therefore, if any upward force is applied to the sash from outside the window the net result is a compressive force being established at the interface. This means that the latching effect actually increases as the external force to the window is applied. A compressive force also occurs at the interface of each leg 15 with the upper extremity of the opening 16 to further prevent the fastener from being caused to fail or release and thereby enable the sash to be opened.

Figure 7:
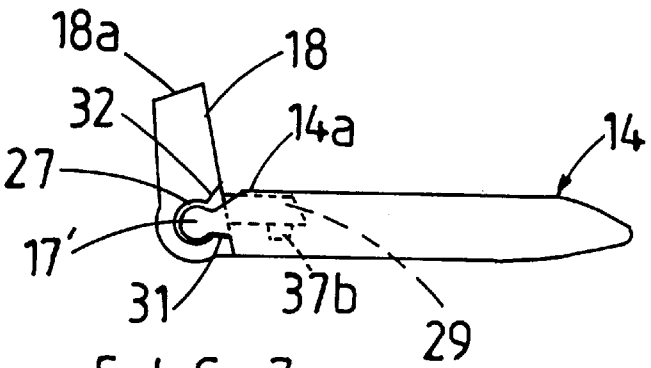
FIG. 7 is a side elevation view of the fastener handle and a latching tongue according to the second form of the invention.
Figure 6:
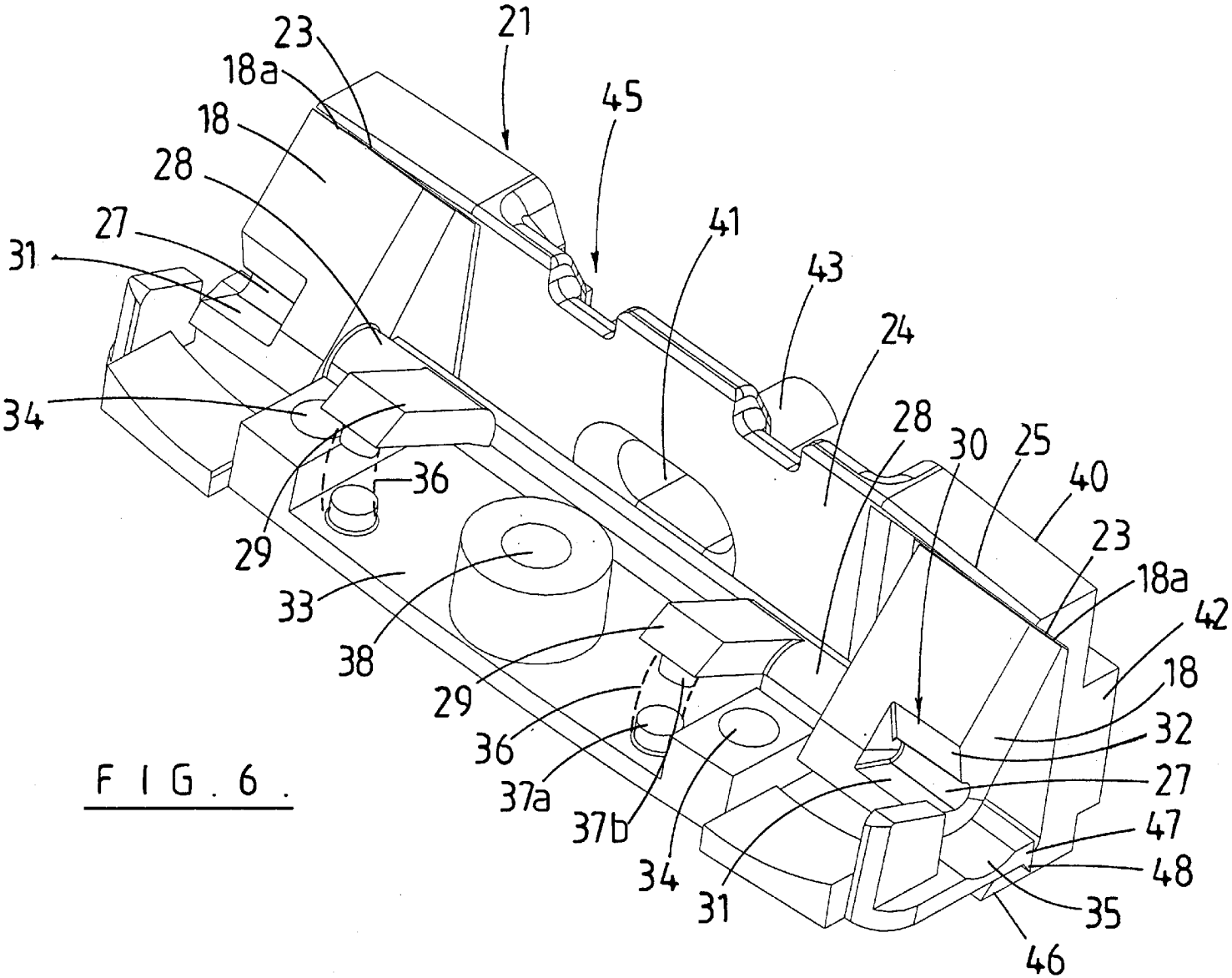
FIG. 6 is a perspective view of part of the fastener according to a second embodiment.

The fastener according to a second form of the invention is shown in FIGS. 6 to 10 of the drawings. In this form of the invention the latch tongue 18 is formed as a separate piece (see FIG. 6) with which the handle 14 engages. In FIG. 6 the handle is not shown nor is the main section of the body 11. The drawing shows, in the interests of clarity only, the pair of latch tongues 18, a cover plate 33 and the latch plate 21. However, FIG. 7 shows the interengagement of handle 14 with a tongue member 18.

The end of tongue 18 opposite to the end having the engagement surface 18*a* has a blind bore 27 into which a stub axle 17' of handle 14 can be axially located. Projecting coaxially from the blind end of bore 27 is a pivot axle 28 with a transverse arm 29 projecting from the end thereof. As shown in FIG. 7, the end of the leg 14*a* of handle 14 extends through a gap 30 in the wall of bore 27, the side walls 31 and 32 of gap 30 by coming into contact with the respective opposite surfaces of leg 14*a* limiting the extent by which relative rotational movement between tongue 18 and handle 14 can occur.

Within body 11 are a pair of semi-circular bearing surfaces 35' and opposing curved bearing surfaces 35 between which the pivot axles 28 can rotatably journal. A cover plate 33 is locatable over the pivot axles 28 to capture the pivot axles in place. Plate 33 has a pair of openings 34 through which studs 52 (see FIG. 10) of the main body 11 locate, the distal (and hence external) ends of these studs being able to be swaged or enlarged to capture the plate 33 in place on body 11. The swaging is not shown in FIG. 10.

The spring bias in this form of the invention is formed by a pair of springs 36, each being engaged between projections 37*a* of cover plate 33 and projections 37*b* of arms 29. Accordingly, the tongues 18 are biased to the latching position.

A bore 38' in body 11 and an aligned bore 38 in cover plate 33 respectively permit a mechanical fastener (not shown) to pass therethrough for mounting of the body 11 to the sash S of a window. Bore 38' is located in a recess 54 which after the fastener is in place is covered by a removable cover (not shown).

The cover plate 33 can have spigots 50 projecting from the external surface (ie the underside of plate 33 as viewed in FIG. 6) to engage in holes or recesses in the mounting surface S' of the sash S (see FIG. 8) to further locate and orientate the fastener in place on the sash.

A downward pressure on handle 14 (see arrow A in FIG. 8) results in the surfaces of the legs 14a adjacent stub axle 17' to push on side walls 31 of the gaps 30 through which the legs 14*a* project into bore 27. This causes the tongues 18 to pivotally retract about axles 28 so as to move engaging surfaces 18*a* away from contact with the latching shoulder 23. Upon release of the handle 14 the handle and tongues 18 are biased by springs 36 back to the latching position, ie projecting position. When the sash S is moved back to the closed position the tongues 18 ride over surfaces 25 as previously described (though in this embodiment surfaces 25 are more in the form of flat surfaces more or less at right angles to the plane of plate 21). However, during this action the tongues 18 move independently of handle 14. The extent of such movement is limited by side walls 32 of gaps 30 contacting the leg 14*a* adjacent stub axle 17' of handle 14.

Consequently, as the window sash moves toward final closing the possibility of the fingers of the user inadvertently becoming caught between the handle and the sash is prevented due to the movement of the tongues 18 being independent of the handle. The accidental catching of the user's finger(s) is a possibility with the first form of the invention where the handle moves in unison with the tongues 18 as they move over the ramp surfaces 25.

In this second form of the invention refinements are incorporated to aid not only the mounting of the fastener with a window construction but also to improve security.

As shown in FIG. 6, there is provided a single opening 41 through which a mechanical fastener (not shown) can pass to mount the latch plate 21 to the window frame F. However, in order to further locate the latching plate 21 with the frame F there is provided an elongate angular projection 42 which extends from the rear surface 40 of the latching plate. This projection 42 fits into grooved recess R in frame F.

Also projecting from the rear of the latching plate 21 is a finger 43 and a pair of abutments 44, these being located in the general vicinity of the opening 41. These are of a length to engage with the floor of the grooved recess R' so that over-tightening of the mechanical fastener through opening 41 will not result in deforming of the latching plate 21.

Figure 8:
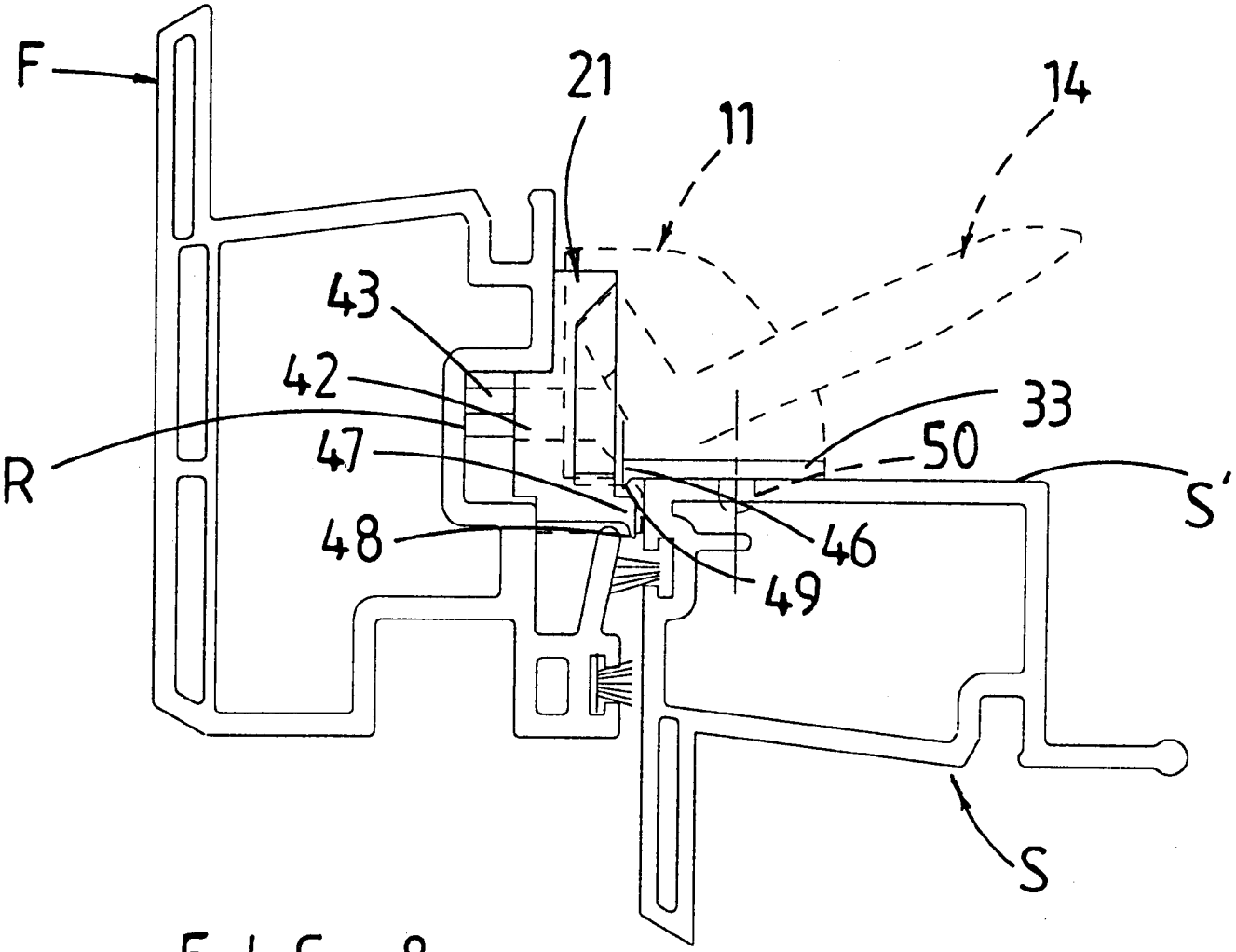
FIG. 8 is a side elevation view of part of a window with the fastener of the second form installed.
Figure 10:
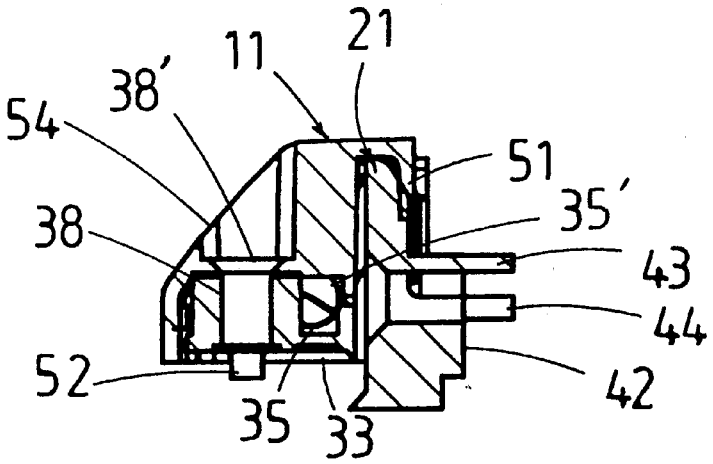
FIG. 10 is a section on line A—A of FIG. 9.
Figure 9:
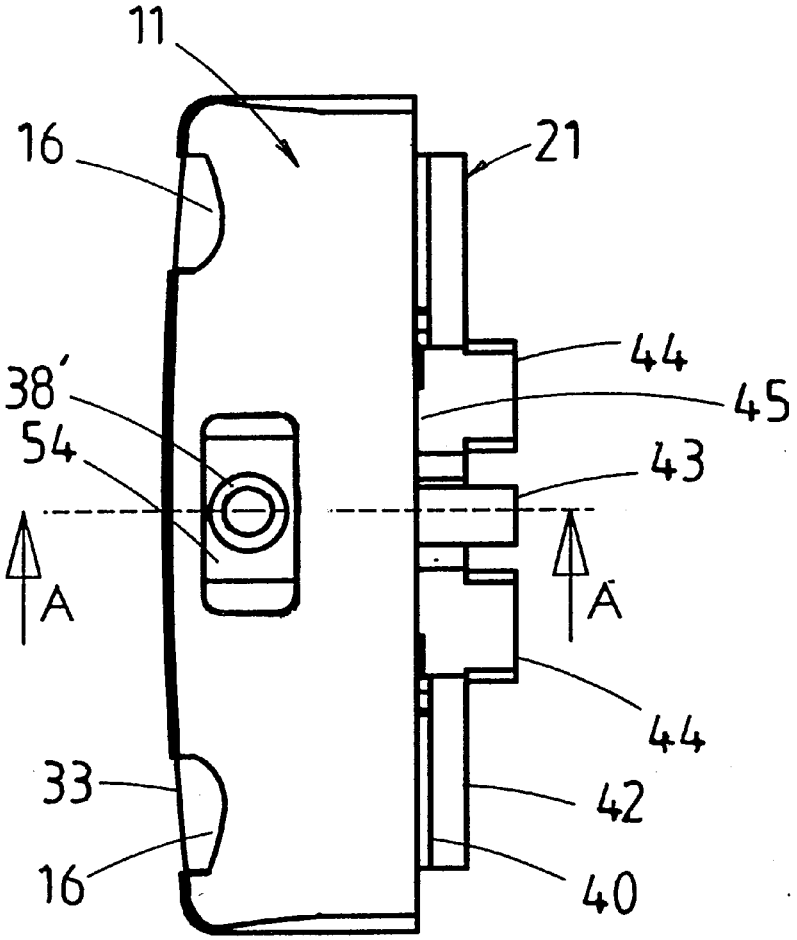
FIG. 9 is a plan view of the second form of the invention but without the handle shown.

As can be seen from FIG. 8, the latching plate 21 fits partially within the confines of the body 11. This permits a finger 51 (see FIG. 10) extending downwardly from the terminal edge of the body 11 to engage in a recess 45 in the rear surface 40 of the latching plate 21. Accordingly, a portion of the latching plate 21 is sandwiched (see FIG. 10) within the body 11 so that any force applied from externally to try and separate the sash laterally from the frame and thereby release the interlatching effect of tongues 18 and shoulders 23 is resisted.

Also with this type of sliding window, it is known for someone trying to make unauthorized forced entry to push a card or other thin object between the latching plate 21 and the tongues 18 to release the tongues from their latching engagement. To overcome this with the arrangement illustrated in FIGS. 6 and 8 the bottom of the latching plate 21 provides a ledge 46 which overlaps with the longitudinal edge 47 of cover 33. This edge 47, however, has a downwardly projecting rib 48 which further assists in the resistance to forcing of card between the latching plate 21 and edge 47 of cover 33.

Even further, the longitudinal edge of the ledge 46 is, as shown in FIG. 8, also provided with a downwardly projecting lip 49. This provides further security by tending to direct any card inserted between the sash and the frame away from the gap between the edge of ledge 46 and the sash.

The window fastener according to the present invention thus provides for automatic relatching of the fastener whenever the window sash is moved to the closed position in the frame. Furthermore, the construction of the fastener is such that any attempt to release the fastener or cause it to fail by the application of an external force to the window causes the latching effect to increase. Furthermore, the fastener is one which is easy to operate in order to release the fastener to enable the window to be opened as the fastener can be simply gripped as part of the normal gripping procedure of a person engaging the sash and moving it upwardly to a closed position.

While the present invention is particularly described and shown as being useable with a vertically slideable sash it can equally be used with horizontally sliding sashes.

What is claimed is:

1. A fastener for a sliding sash window, the fastener comprising: a body, a cover removably fitted to said body, a handle pivotally mounted with said body to be movable between first and second positions, two latching means operatively coupled to said handle, biasing means to bias the handle to said first position, a latch plate having latching surfaces with each of which one of said latching means is engageable substantially face to face and an abutment adjacent the latching surfaces, the latching means being movable from engagement with the latching surface to a non-latching position in response to the handle being moved to said second position, movement inducing means to cause the latching means to move to said non-latching position in response to relative movement between the body and latch plate in a closing direction corresponding to that in which a window to which the fastener is attached moves to a closed position, the latching surface being located forward of the axis of pivotal movement of the handle in a direction opposite to said closing direction, and located at an incline relative to said closing direction.

2. A fastener as claimed in claim 1 wherein the biasing means is at least one spring.

3. A fastener as claimed in claim 1 wherein the latch plate includes a lip intended for engaging with an edge of a window frame.

4. A fastener as claimed in claim 1 wherein the handle is substantially U-shaped with a transverse extension from the end of each leg of the U-shape forming said latching means, the handle being mounted by pivot means, the pivot axis of which is located adjacent the interconnection of each said transverse extension and the end of respective each leg, said pivot axis being located substantially laterally relative to the legs of the U-shaped handle.

5. A fastener as claimed in claim 1 wherein the body includes separate openings through which respective of the legs of the U-shaped handle extend, there being further separate openings through which respective of the transverse extensions project.

6. A fastener for a window having a sash movable in a sliding direction between open and closed positions, the fastener comprising: a body, a handle pivotally mounted with the body, a pair of spaced apart latching tongues coupled to the handles, a latching plate having two spaced apart latching surfaces with each of which an engagement surface of one of said latching tongues is engageable when the fastener is in a latching position, all abutment means located between the latching surfaces, each latching surface being located at an angle to the sliding direction whereby the handle is pivotally movable to move said latching tongues from said latching position to a non-latching position where the latching tongues are clear of the latching plate, there being biasing means to bias the latching tongues to said latching position, and movement inducing means engageable with the latching tongues as the body is moved relative to the latch plate along the sliding direction to the closed position to cause the latching tongues to move against the bias of biasing means, said latching tongues being movable under the effect of the movement inducing means independent of the handle.

7. A fastener as claimed in claim 6 wherein each latching tongue is pivotally coupled to said handle but restricted to limited pivotal movement relative to the handle.

8. A fastener as claimed in claim 7 wherein the tongue includes axle means about the axis of which said handle is pivotally movable.

9. A fastener as claimed in claim 8 wherein the biasing means is a spring engaged between part of said body and a lever arm associated with the latching tongue.

10. A fastener as claimed in claim 9 wherein the handle is of substantially U-shape, the ends of the legs thereof being mounted by a said axle means of a said tongue such that the handle is pivotally movable about a pivot axis formed by the axle means, the latching tongue projecting transverse to the handle legs and pivot axis.

11. A sliding sash window in combination with a fastener as claimed in claim 6, the body being mounted to the sash and the latch plate mounted to a surface of the frame of the window, said frame surface being substantially parallel to the sliding direction of the sash.

12. A fastener for a window having a sash movable in a sliding direction between open and closed positions, the fastener comprising: a body, a handle pivotally mounted with the body, a pair of latching tongues operable to the handle, a latching plate having a pair of latching surfaces with each of which an engagement surface of a latching tongue is engageable when the fastener is in a latching position, the latching surface being located at an angle to the sliding direction whereby the handle is pivotally movable to move said latching tongues from said latching position to a non-latching position where the latching tongues are clear of the latching plate, and biasing means to bias the latching tongues to said latching position, said latching tongues being mounted on the body to be movable independent of one another against the bias of said biasing means.

13. The fastener of claim 12, further comprising movement inducing means engageable with the latching tongues as the body is moved relative to the latch plate along the sliding direction to the closed position to cause the latching tongue to move against the bias of the biasing means, said latching tongues being coupled to the handle to be movable independent of the handle when said latching tongues are moved by the movement inducing means.

14. The fastener of claim 13 further comprising an abutment located between the pair of latching surfaces.

15. The fastener of claim 12 wherein each latching tongue is pivotally mounted with the body to be pivotal about a first pivot axis.

16. The fastener of claim 15 wherein the latching tongue comprises a lever arm, the biasing means being formed by a spring means located between said lever arm and locating element fixed in relation to the body.

17. The fastener of claim 15 wherein the handle is pivotally coupled to the latching tongue, the handle being capable of limited pivotal movement about a second pivot axis relative to the latching tongue, the latching tongue including a first surface with which a part of the handle is engageable at one extreme of said limited pivotal movement.

18. The fastener of claim 17 wherein the tongue comprises a second surface with which a part of the handle is engageable at another extreme of said limited pivotal movement.

19. The fastener of claim 18 wherein the first pivot axis and the second pivot axis are substantially parallel.

* * * * *